US009583872B2

(12) United States Patent
Matsuyama

(10) Patent No.: US 9,583,872 B2
(45) Date of Patent: Feb. 28, 2017

(54) CONNECTOR ASSEMBLY HAVING AN ELASTIC ENGAGING PORTION

(71) Applicant: Molex, LLC, Lisle, IL (US)

(72) Inventor: Kotaro Matsuyama, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/040,497

(22) Filed: Feb. 10, 2016

(65) Prior Publication Data

US 2016/0248190 A1 Aug. 25, 2016

(30) Foreign Application Priority Data

Feb. 25, 2015 (JP) ..... 2015-035735

(51) Int. Cl.
*H01R 13/627* (2006.01)
*H01R 12/71* (2011.01)
*H01R 13/641* (2006.01)

(52) U.S. Cl.
CPC ..... *H01R 13/6273* (2013.01); *H01R 13/6271* (2013.01); *H01R 12/716* (2013.01); *H01R 13/641* (2013.01)

(58) Field of Classification Search
CPC ... H01R 13/502; H01R 13/506; H01R 13/508; H01R 13/514; H01R 13/516; H01R 13/518; H01R 13/62; H01R 13/627; H01R 13/6271; H01R 13/6395; H01R 13/6272; H01R 13/6275
USPC ..... 439/701, 356, 361, 368, 370, 352
See application file for complete search history.

(56) References Cited

U.S. PATENT DOCUMENTS

| | | | | |
|---|---|---|---|---|
| 5,330,366 | A * | 7/1994 | Tsuji | H01R 13/633 439/352 |
| 6,676,433 | B1 * | 1/2004 | Ozaki | H01R 13/5025 439/350 |
| 7,214,086 | B1 * | 5/2007 | Hsieh | H01R 13/53 439/352 |
| 2011/0086535 | A1 * | 4/2011 | Yeh | H01R 9/2408 439/357 |
| 2016/0197440 | A1 * | 7/2016 | Suzuki | H01R 13/6271 439/352 |

FOREIGN PATENT DOCUMENTS

| | | |
|---|---|---|
| JP | 2007-066544 A | 3/2007 |
| JP | 2008-027727 A | 2/2008 |
| JP | 2009-004174 A | 1/2009 |
| JP | 2009-266747 A | 11/2009 |
| JP | 2011-238403 A | 11/2011 |

* cited by examiner

*Primary Examiner* — Chandrika Prasad
(74) *Attorney, Agent, or Firm* — James A. O'Malley

(57) ABSTRACT

A connector assembly is provided which includes a first connector having a first housing and a second connector having a second housing. The first housing has two fixed portions positioned apart from one another in the transverse direction, an elastic portion passing between the two fixed portions and able to bend elastically in the longitudinal direction, and an engaging protruding portion formed on the elastic portion and able to be hooked in an engaging hole in the second housing. The engaging protruding portion is positioned between upper and lower edges of the elastic portion.

6 Claims, 6 Drawing Sheets

CONNECTOR ASSEMBLY HAVING AN ELASTIC ENGAGING PORTION

RELATED APPLICATIONS

This application claims priority to Japanese Application No. 2015-035735, filed Feb. 25, 2015, which is incorporated herein by reference in its entirety.

TECHNICAL FIELD

The present disclosure relates to a technique for improving the coupling stability of two connectors.

BACKGROUND ART

A female connector and a male connector have been disclosed in Patent Document 1. The female connector has a housing holding a plurality of terminals, and the male connector also has a housing holding a plurality of terminals. On the outer surface of the housing of the female connector, bending portions are formed at both ends which are fixed to the outer surface of the housing of the female connector. The housing has an arm portion extending from each bending portion, and an engaging hole is formed in each arm portion. Engaging protruding portions are formed in the housing of the male connector. The female connector and the female connector are coupled to each other by hooking the protruding portions of the male connector in the engaging holes of the female connector.

Patent Document 1 Laid-Open Patent Publication No. 2009-266747

SUMMARY

In Patent Document 1, engaging holes are formed in arm portions extending from bending portions. When external force is applied to the arm portions and bending portions of the female connector, the arm portions become inclined and the engaging holes and engaging portions may become disengaged. When particularly long arm portions become inclined, the positions of the engaging holes are significantly displaced, and the engaging holes and engaging portions easily become disengaged.

The present disclosure provides a connector assembly that is able to improve the coupling stability of two connectors.

The connector assembly of the present disclosure comprises a first connector having a first housing for holding first terminals, and a second connector having a second housing for holding second terminals and configured to be coupled with the first housing in a first direction. The second housing has a second engaging portion. The first housing has two fixed portions positioned apart from one another in a second direction orthogonal to a first direction, an elastic portion passing between the two fixed portions and bending in a third direction orthogonal to both the first direction and the second direction, and a first engaging portion formed on the elastic portion and able to be hooked on the second engaging portion. The elastic portion has a first edge and a second edge positioned on opposite sides in the first direction, and the first engaging portion is positioned between the first edge and the second edge.

In the present disclosure, the first engaging portion is positioned between the first edge and the second edge. In this way, the section in which the engaging portion is formed can be kept from becoming significantly displaced due to unintentional external force better than the convention configuration in which the engaging portion is formed in an arm portion extending from an elastic portion. As a result, the first engaging portion and the second engaging portion are kept from becoming unintentionally disengaged.

Note that the first terminals and the second terminals do not have to be configurational elements in the connector assembly of the present disclosure. For example, the first terminals and the second terminals may be mounted on the end portion of cables, and may be mounted in the first housing and the second housing only when the first connector and the second connector are to be used.

In a connector assembly according to an embodiment of the present disclosure, the first engaging portion may be formed in a portion closer to the first edge than to the second edge, and the first housing may have a section positioned in the first direction relative to the first edge and facing the first edge in the first direction. In this way, the inclination of the section of the elastic portion in which the first engaging portion is formed can be restricted. As a result, the first engaging portion and the second engaging portion are kept from becoming unintentionally disengaged.

In a connector assembly according to an embodiment of the present disclosure, the first edge of the elastic portion may hit the section of the elastic portion facing the first edge before the first engaging portion and the second engaging portion disengage when a section of the first engaging portion formed in the elastic portion is inclined due to force in the separating direction for the first housing and the second housing while the first engaging portion and the second engaging portion are engaged. In this way, the inclination of the section of the elastic portion in which the first engaging portion is formed can be restricted. As a result, the first engaging portion and the second engaging portion are kept from becoming unintentionally disengaged. Note here that the 'first edge of the elastic portion' includes the edge of the first engaging portion when the protruding portion formed in the elastic portion serves as the first engaging portion. For example, when the protruding portion serving as the first engaging portion is formed along the lower edge of the elastic portion, the lower edge (lower end) of the protruding portion is included in the 'lower edge of the elastic portion'.

In a connector assembly according to an embodiment of the present disclosure, either the section of the elastic portion facing the first edge or the first edge of the elastic portion may have a protruding portion protruding towards the other one. Because the protruding portion is gently hit when the section of the elastic portion in which the first engaging portion is formed is inclined, the inclination is more reliably restricted. As a result, the first engaging portion and the second engaging portion are more reliably kept from becoming unintentionally disengaged.

In a connector assembly according to an embodiment of the present disclosure, the protruding portion may be positioned in the first direction relative to the first engaging portion when the first housing is viewed in the third direction. In this way, the inclination of the section of the elastic portion in which the first engaging portion is formed can be more reliably restricted.

In a connector assembly according to an embodiment of the present disclosure, the position of the first engaging portion in the first direction may be between the position of the one end portion and the position of the other end portion of the fixed portion in the first direction. In this way, the inclination of the section of the elastic portion in which the first engaging portion is formed can be more reliably restricted.

In a connector assembly according to an embodiment of the present disclosure, the elastic portion may have at least two first engaging portions positioned apart from one another in the second direction. In this way, the coupling of the first connector and the second connector can be further stabilized.

In a connector assembly according to an embodiment of the present disclosure, the first engaging portion may be formed at a position closer to the first edge than to the second edge, the first housing may have a section positioned in the first direction relative to the first edge and formed along the first edge, and an end portion of the first edge may be connected to the section formed along the first edge. By adjusting the width of the connected section in this way, the bending of the elastic portion can be controlled and the inclination of the section in which the first engaging portion is formed can be restricted.

BRIEF DESCRIPTION OF THE DRAWINGS

FIG. 3A is a front view and FIG. 3B is a cross-sectional view from line IIIb-IIIb in FIG. 3A.

DETAILED DESCRIPTION OF THE PREFERRED EMBODIMENTS

Figure 1:
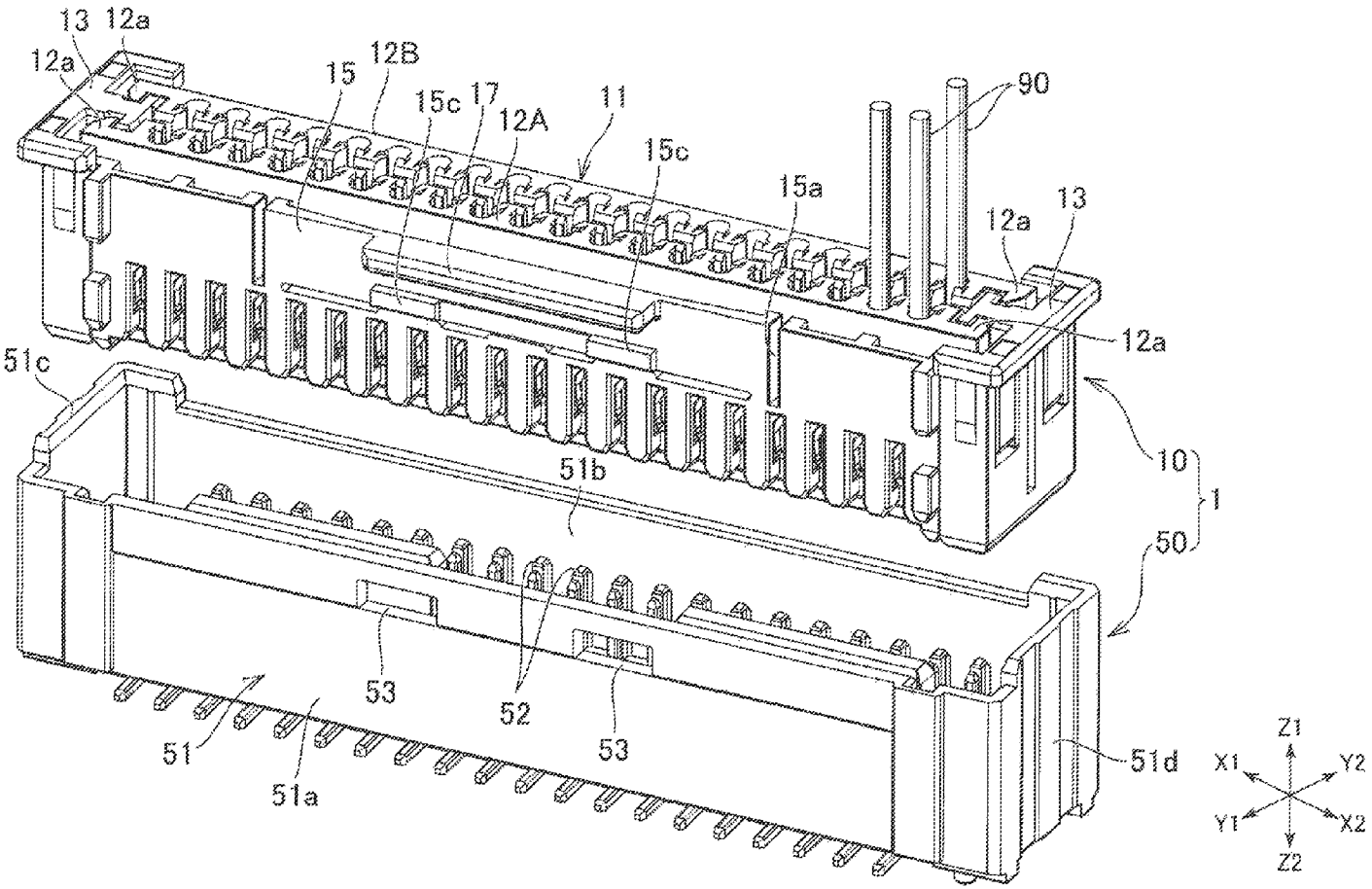
FIG. 1 is a perspective view of the connector assembly in an embodiment of the present disclosure.

In the following explanation, the directions indicated by Z1 and Z2 in FIG. 1 are the upward and downward directions, respectively (collectively the 'vertical direction'), the directions indicated by Y1 and Y2 in FIG. 1 are the forward and rearward directions, respectively (collectively the 'longitudinal direction'), and the directions indicated by X1 and X2 are the rightward and leftward directions, respectively (collectively the 'transverse direction'). The directions indicated by these letters and numbers are used to explain the relative positional relationship between the components constituting the connector assembly 1. They do not indicate absolute directions and do not limit the orientation of the connector assembly 1 during actual use. In the example described below, the coupling direction of the first connector 10 and the second connector 50 is the vertical direction with the first connector 10 positioned above the second connector 50. The 'first direction', the 'second direction', and the 'third direction' mentioned in the claims correspond to the 'vertical direction', the 'transverse direction', and the 'longitudinal direction' in the present embodiment.

As shown in FIG. 1, a connector assembly 1 of an embodiment of the present disclosure has a first connector 10 and a second connector 50. The connectors 10, 50 are used to connect a plurality of cables to a circuit board (not shown). For example, the first connector 10 is mounted on the ends of a plurality of cables 90, and the second connector 50 is mounted on a circuit board (not shown). The connectors 10, 50 of the present disclosure may be used to connect a set of cables to another set of cables, or may be used to establish an electrical connection between two circuit boards. In still another example, the first connector 10 may be mounted on a circuit board, and the second connector 50 may be mounted on the ends of a plurality of cables.

The second connector 50 has a second housing 51. The second housing 51 is molded from an insulating material (such as a resin). One example of the second housing 51 is a box open on the top as shown in FIG. 1. In other words, the second housing 51 shown in FIG. 1 has a plurality of wall portions 51*a*-51*d* (four in FIG. 1) and opening above the wall portions 51*a*-51*d*.

Figure 5:
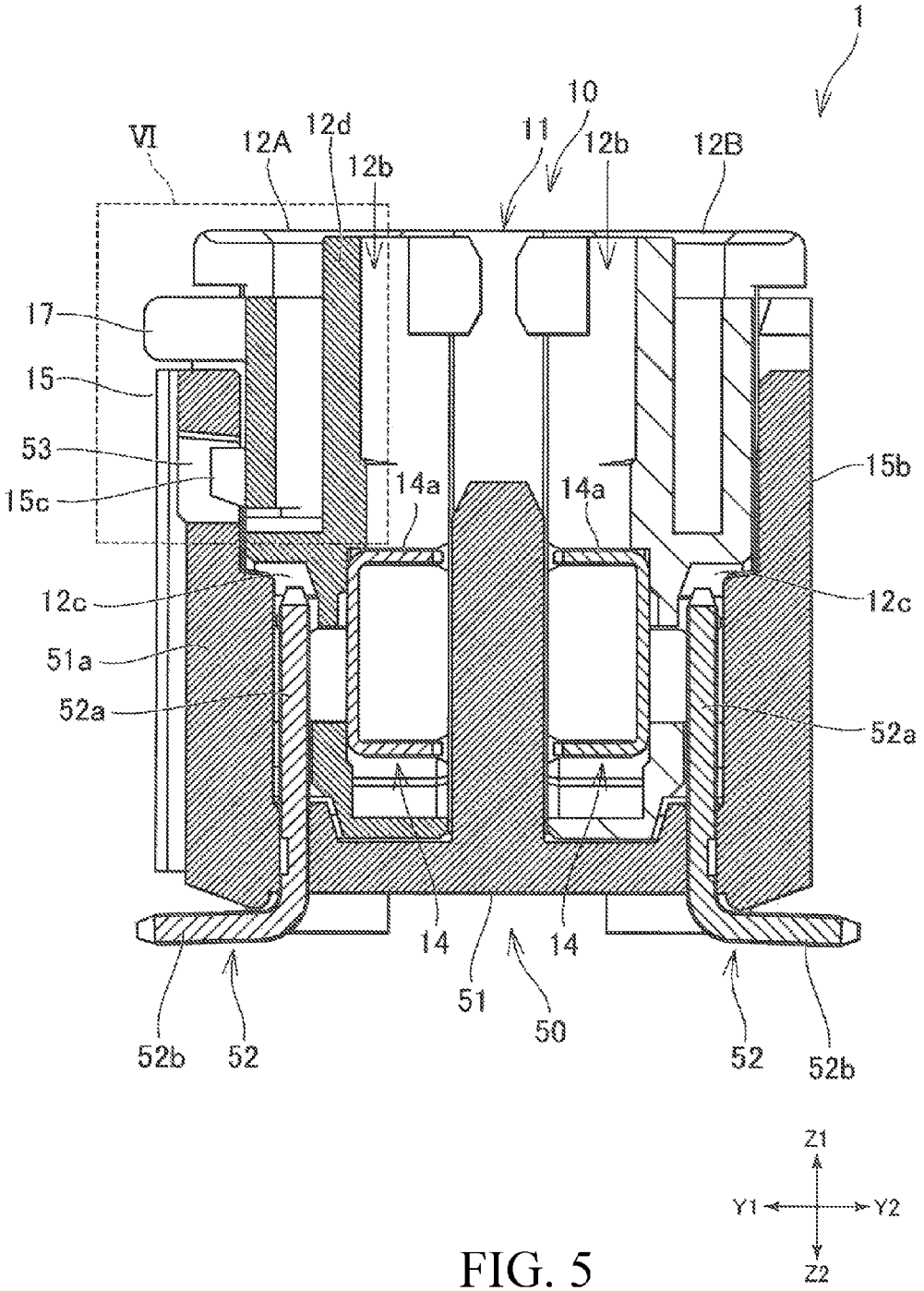
FIG. 5 is a cross-sectional view from line V-V in FIG. 4.

The second housing 51 holds a plurality of terminals 52. The terminals 52 in the second connector 50 have, as shown in FIG. 5, an L-shaped profile, a connecting portion 52*a* arranged inside the second housing 51 and extending upwards, and a mounted portion 52*b* connected to the base portion (bottom end) of the connecting portion 52*a* and curving towards the connecting portion 52*a*. In one example of the second connector 51, the mounting portion 52*b* is mounted on a circuit board when the second connector 50 is used. In FIG. 1, a plurality of terminals 52 are arranged side by side in the transverse direction. The plurality of terminals 52 form a plurality of rows (two rows in FIG. 1) separated by a gap in the longitudinal direction. There are no particular restrictions on the shape and arrangement of the terminals 52. For example, the second connector 50 may include a single row of terminals 52.

Figure 3A:
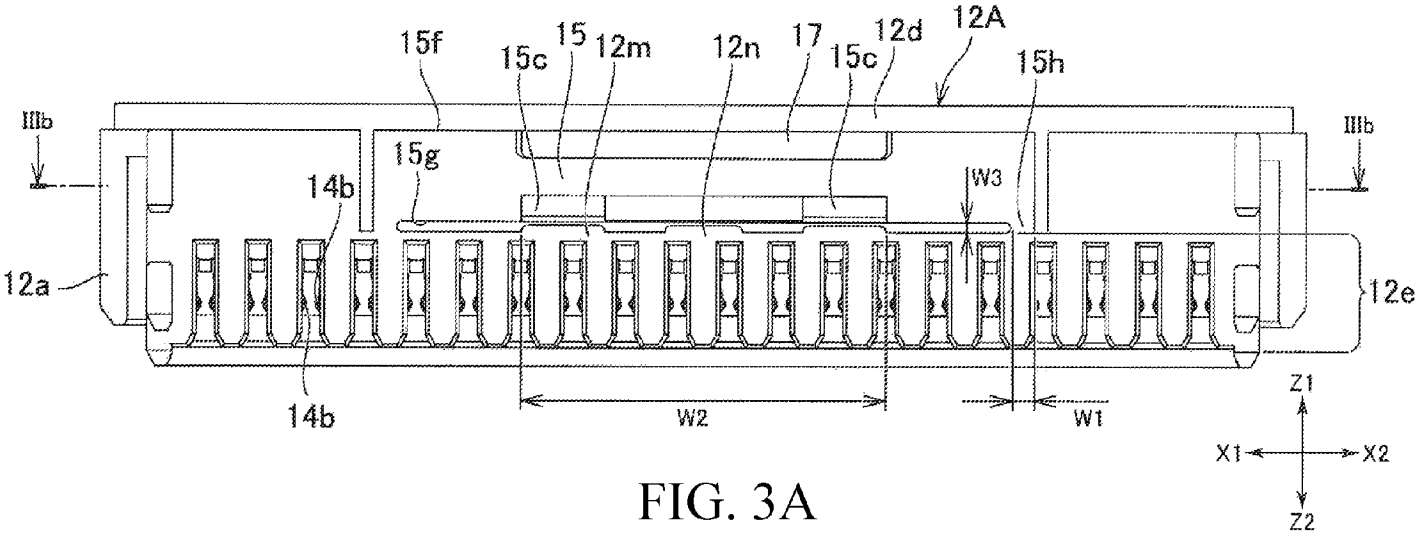
FIGS. 3A and 3B are a pair of diagrams showing the terminal holding member constituting the first connector, where
Figure 3B:
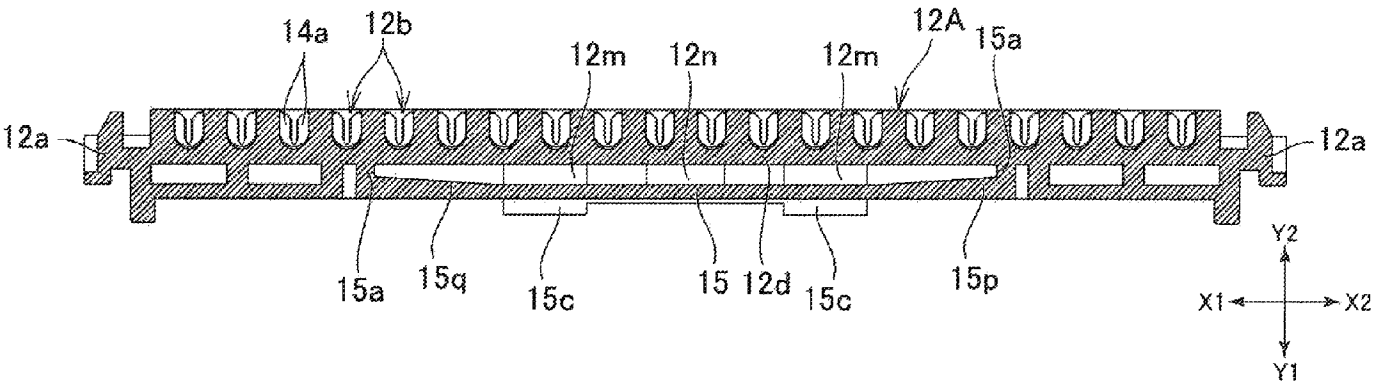

As shown in FIG. 1, the first connector 10 has a first housing 11 for holding a plurality of terminals 14 (see FIGS. 3A, 3B and FIG. 5). The first housing 11 is molded from an insulating material (such as a resin). The first housing 11 and the second housing 51 are configured so as to be coupled together. In one example, the first housing 11 can be fitted inside the second housing 51 (more specifically, inside the four wall portions 51*a*-51*d*). The first housing 11 and the second housing 51 have engaging portions which engage each other, and the housings 11, 51 are coupled together when these engaging portions are engaged. The engaging portions will be explained below in greater detail.

Each terminal 14 is connected to a separate cable 90 (see FIG. 1). For example, when electrical wires are exposed at the ends of the cables 90, the terminals 14 are connected to the ends of the cables 90 (the ends of the electrical wires). When terminals are attached to the ends of the cables 90, the terminals 14 are connected to the terminals of the cables 90. The first housing 11 may also hold terminals 14 mounted to a circuit board when used.

In one example of the first connector 10, the first housing 11 has two terminal holding members 12A, 12B arranged in the longitudinal direction, and holders 13 to be coupled with the two terminal holding members 12A, 12B. The holders 13 are mounted, respectively, on a right end portion and a left end portion of the two terminal holding members 12A, 12B to hold them. In one example of the first housing 11, as shown in FIGS. 3A and 3B, guides 12*a* extending vertically are formed on the right end portion and the left end portion of the two terminal holding members 12A, 12B. Grooves extending vertically are formed in the holders 13, and the guides 12*a* are inserted vertically into the grooves in the holders 13. In this way, the two terminal holding members 12A, 12B are held by the holders 13.

The structure of the first housing 11 is not limited to the one described above. For example, the first housing 11 does not have to have two terminal holding members 12A, 12B. In other words, the first housing 11 may have a single terminal holding member. In another example, holders 13 do not have to be used to hold the two terminal holding members 12A, 12B. In other words, components do not have to be molded to hold the two terminal holding members 12A, 12B. In another example, the first housing 11 may have more than two terminal holding members.

In an example of the first housing 11, as shown in FIG. 5, a plurality of insertion grooves 12*b* for inserting each of the cables 90 are formed in the two terminal holding members 12A, 12B on the side facing the cables. In other words, terminal holding member 12A arranged on the front side has insertion grooves 12*b* arranged on the rear side (see FIG. 2). Terminal holding member 12B arranged on the rear side has insertion grooves 12*b* arranged on the front side. Each insertion groove 12*b* extends in the vertical direction, and the insertion grooves 12*b* are arranged side by side in the transverse direction. Each terminal 14 has a connecting portion 14*a* connected to the end of a cable 90. Each connecting portion 14*a* is arranged to the inside of the lower portion of an insertion groove 12*b*.

Figure 2:
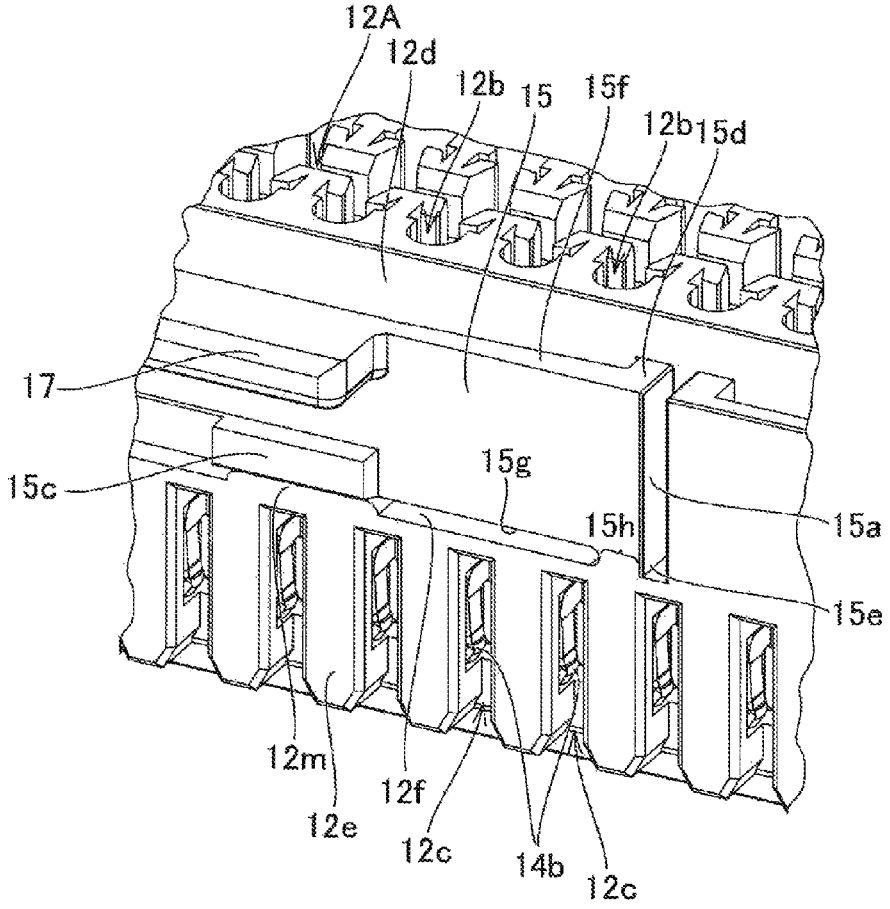
FIG. 2 is a perspective view of a preferred embodiment of a portion of the connector assembly.

As shown in FIG. 2 and FIG. 5, each terminal holding member 12A, 12B has a plurality of fitting grooves 12*c* extending towards the lower end of the terminal holding member 12A, 12B. The plurality of fitting grooves 12*c* are arranged side by side in the transverse direction. In one example of terminal holding member 12A, the fitting grooves 12*c* are exposed on the front surface of the first housing 11. In one example of terminal holding member 12B, the fitting grooves 12*c* are exposed on the rear surface of the first housing 11. Each terminal 14 has two contact points 14*b* arranged inside a fitting groove 12*c* so as to face each other (see FIG. 3A). When the connectors 10, 50 are coupled with each other, the connecting portions 52*a* of the terminals 52 of the second connector 50 described above are inserted from below into the fitting grooves 12*c* and brought into contact with the contact points 14*b* of the terminals 14. More specifically, the connecting portions 52*a* are interposed between two contact points 14*b*. In this way, an electrical connection is established between the cables 90 and the terminals 52 of the second connector 50.

The terminal holding members 12A, 12B are not restricted to the structure for holding cables 90 or the structure for establishing contact between the terminals 14 and the terminals 52 of the second connector 50 described above. These can be changed if necessary. In one example, each of the terminal holding members 12A, 12B may have holes formed through the member in the vertical direction, the cables 90 may be inserted into the through-holes from above, and the connecting portions 52*a* of the second connector 50 may be inserted into the through-holes from below.

The first housing 11, as shown in FIGS. 3A and 3B, has two fixed portions 15*a* positioned apart from one another in the transverse direction. The first housing 11 also has an elastic portion 15 which passes between the two fixed portions 15*a* and is able to bend elastically in the longitudinal direction. The elastic portion 15 has two edges positioned on opposite sides in the vertical direction and extending linearly in the transverse direction. In other words, the elastic portion 15 has an upper edge 15*f* and a lower edge 15*g*. The lower edge 15*g* is the edge positioned closer to the second connector 50 than the upper edge 15*f*. The upper edge 15*f* and the lower edge 15*g* do not connect to other portions of the first housing 11. In this way, the elastic portion 15 can bend in the longitudinal direction. In other words, the central section of the elastic portion 15 can be elastically bent in a concave or convex manner.

The thickness of the elastic portion 15 may be constant in the transverse direction. As shown in FIG. 3B, the thickness of the elastic portion 15 may be such that the right side portion 15*p* and the left side portion 15*q* of the elastic portion 15 become larger as the right end portion and the left end portion of the elastic portion 15 are approached. This shape easily adjusts the force required to elastically deform the elastic portion 15.

As shown in FIG. 3B, the terminal holding member 12A has an upper body 12*d* in which a plurality of insertion grooves 12*b* are formed side by side in the transverse direction. In an example of the first housing 11, as shown in FIG. 1, the fixed portion 15*a* is formed in the front surface of the first housing 11, that is, in the front surface of the upper body 12*d* of the terminal holding member 12A arranged in front, and the elastic portion 15 is positioned so as to be apart from the front surface of the upper body 12*d*. The fixed portion 15*a* and the elastic portion 15 may be formed in other positions in the first housing 11. For example, a fixed portion 15*a* and an elastic portion 15 may be formed in the terminal holding member 12B arranged in addition to the terminal holding member 12A in front or instead of in the terminal holding member 12A in the front.

An engaging portion is formed in the elastic portion 15. The engaging portion is, for example, a protruding portion extending in the longitudinal direction or a hole recessed in the longitudinal direction. In the second housing 51, an engaging portion is formed as a protruding portion or hole able to engage the engaging portion on the elastic portion 15. The two housings 11, 51 are coupled when the engaging portion on the first housing 11 and the engaging portion on the second housing 51 engage each other.

In the present embodiment, as shown in FIG. 2, the elastic portion 15 has a protruding portion 15*c* extending in the forward direction as an engaging portion (the protruding portion 15*c* being referred to below as the engaging protruding portion). The second housing 51 has a hole 53 in the wall portion 51*a* at the front to receive the engaging protruding portion 15*c* (the hole 53 being referred to below as the engaging hole). The engaging hole 53 is, for example, a hole passing through the wall portion 51*a* of the second housing 51. However, the engaging hole 53 does not have to pass completely through the wall portion 51*a*.

When the first housing 11 is arranged inside the wall portions 51*a*-51*d* of the second housing 51, the lower end of the elastic portion 15 is arranged inside the wall portions 51*a*-51*d*. As shown in FIGS. 3A and 3B, the engaging protruding portion 15*c* is fitted into the engaging hole 53 and the two housings 11, 51 are coupled. While the first housing 11 is being inserted into the wall portions 51*a*-51*d* of the second housing 51, the central portion of the elastic portion 15 is temporarily bent (temporarily bowed) and the engaging protruding portion 15*c* overcomes the edge (upper edge) of the wall portion 51*a* of the second housing 51. When the engaging protruding portion 15*c* reaches the position of the engaging hole 53, the shape of the elastic portion 15 is restored and the engaging protruding portion 15*c* is fitted into the engaging hole 53.

The elastic portion 15 may have a plurality of engaging protruding portions 15*c* positioned apart from one another in the transverse direction. Similarly, the second housing 51 may have a plurality of engaging holes 53 positioned apart from one another in the transverse direction. In one example, as shown in FIGS. 3A and 3B, two engaging protruding portions 15*c* and two engaging holes 53 are formed. The number of engaging protruding portions 15*c* and the number of engaging holes 53 may be one.

As shown in FIGS. 3A and 3B, the elastic portion 15 is rectangular and has two edges (an upper edge 15*f* and a lower edge 15*g*) positioned on opposite sides in the coupling direction of the two housings 11, 51 (that is, in the vertical direction). When the first housing 11 is viewed from the front, the engaging protruding portion 15*c* of the first housing 11 is positioned between the upper edge 15*f* and the lower edge 15*g* of the elastic portion 15.

In a structure in which an extended portion extends vertically above or below the elastic portion and an engaging portion is formed in the extended portion, the engaging portion is displaced more when the extended portion is included. As a result, the engaging portion and the engaging hole are easily disengaged. In the present embodiment, on the other hand, the engaging portion 15*c* is positioned between the upper edge 15*f* and the lower edge 15*g* of the elastic portion 15. As a result, the engaging protruding portion 15*c* is not displaced very much even when the elastic portion 15 is subjected to external force and becomes inclined. This can keep the engaging protruding portion 15*c* and the engaging hole 53 from becoming unintentionally disengaged.

As shown in FIG. 2, the fixed portion 15*a* extends from the upper end 15*d* to the lower end 15*e* and is connected to the front surface of the upper body 12*d* of the terminal holding member 12A. The position of the engaging protruding portion 15*c* in the vertical direction is between the position of one end of the fixed portion 15*a* (upper end 15*d*) and the position of the other end (lower end 15*e*) in the vertical direction. In other words, the position of the engaging protruding portion 15*c* is lower than the upper end 15*d* of the fixed portion 15*a* and higher than the lower end 15*e*. This makes it difficult for the section in which the engaging protruding portion 15*c* is formed to become inclined. As a result, the engaging protruding portion 15*c* and the engaging hole 53 are more effectively kept from becoming unintentionally disengaged. In one example of a first housing 11, the lower end 15*e* of the fixed portion 15*a* is connected to the upper surface 12*f* of the lower body 12*e* (see FIG. 2). The lower end 15*e* of the fixed portion 15*a* may also be separate from the upper surface 12*f* of the lower body 12*e*.

The engaging protruding portion 15*c* is formed in a position closer to the lower edge 15*g* of the elastic portion 15 than to the upper edge 15*f* of the elastic portion 15 (the lower edge 15*g* corresponding to the 'first edge' in the claims). In one example of the first housing 11, the lower edge of the engaging protruding portion 15*c* is positioned at the same height as the lower edge 15*g* of the elastic portion 15. The position of the engaging protruding portion 15*c* is not limited to this. The engaging protruding portion 15*c* may be above the lower edge 15*g* of the elastic portion 15. The first housing 11 has a section positioned below the lower edge 15*g* of the elastic portion 15 and facing the lower edge 15*g* of the elastic portion 15 in the vertical direction.

Figure 6B:
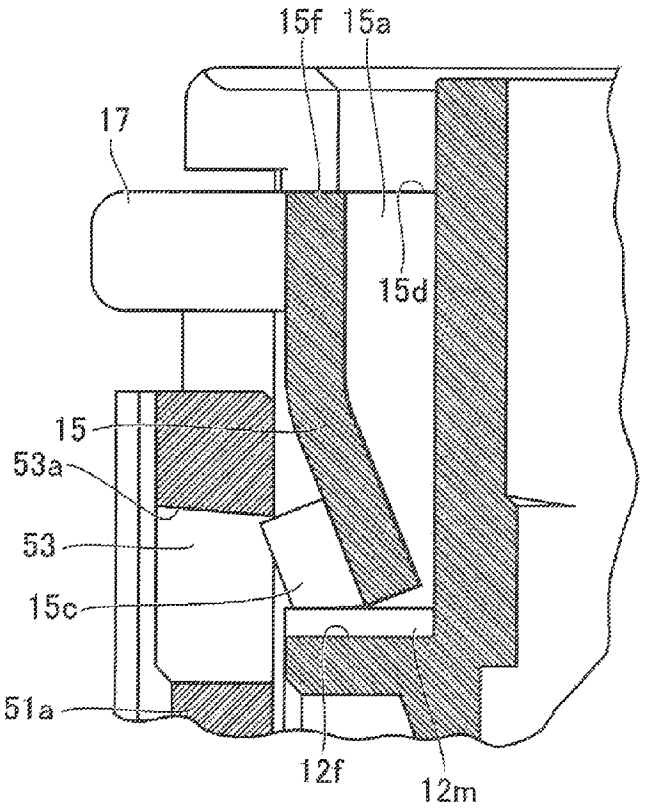
FIGS. 6A and 6B show the portion surrounded by dotted line VI in FIG. 5 where, in FIG. 6B, a section of the elastic portion has become inclined due to force in the separating direction for the two connectors.
Figure 6A:
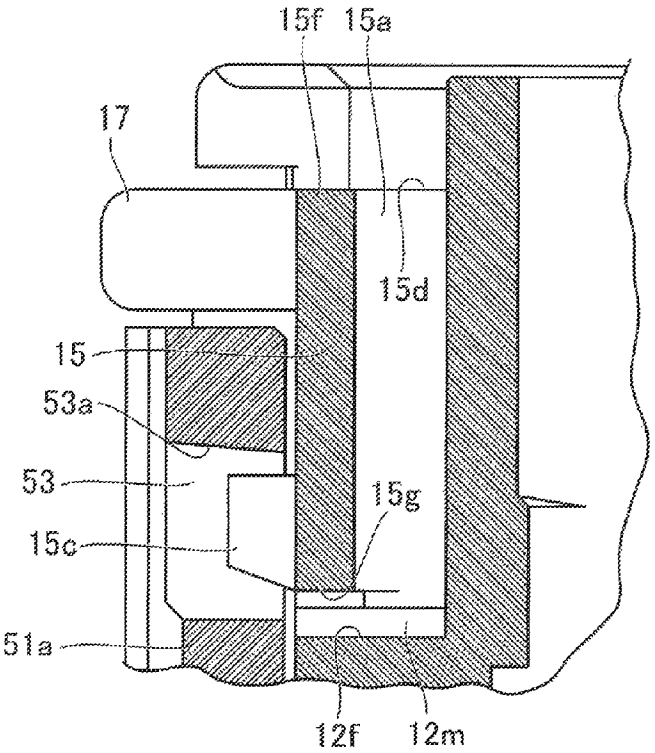

In one example of a terminal holding member 12A, as shown in FIG. 6A, the section facing the lower edge 15*g* of the elastic portion 15 has the upper surface 12*f* of the lower body 12*e* in which a plurality of fitting grooves 12*c* have been formed (in the following explanation, the "lower edge 15*g* of the elastic portion 15" includes the lower edge (lower end) of the engaging protruding portion 15*c*). The upper surface 12*f* of the lower body 12*e* is positioned below the lower edge 15*g* of the elastic portion 15 and faces the lower edge 15*g*. A gap is formed between the upper surface 12*f* of the lower body 12*e* and the lower edge 15*g* of the elastic portion 15. The upper surface 12*f* of the lower body 12*e* extends in the transverse direction and is formed along the lower edge 15*g*. The shape of the terminal holding member 12A is not limited to the one described above. For example, the wall portion and protruding portion extending forward from the upper body 12*d* and facing the lower edge 15*g* of the elastic portion 15 in the vertical direction may be formed below the lower edge 15*g* of the elastic portion 15 instead of on the upper surface 12*f* of the lower body 12*e*.

As shown in FIG. 6B, when the engaging protruding portion 15*c* and the engaging hole 53 are engaged and force is applied in the direction separating the first housing 11 and the second housing 51, the engaging protruding portion 15*c* hits the upper edge 53*a* of the engaging hole 53. As a result, the section of the elastic portion 15 in which the engaging protruding portion 15*c* is formed becomes inclined. At this time, before the engaging protruding portion 15*c* and the engaging hole 53 become disengaged, that is, before the engaging protruding portion 15*c* is pulled out of the engaging hole 53, the lower edge 15*g* of the elastic portion 15 hits the upper surface 12*f* of the lower body 12*e*. As a result, the inclination of the section of the elastic portion 15 in which the engaging protruding portion 15*c* is formed can be restricted. This can more reliably keep the engaging protruding portion 15*c* and the engaging hole 53 from becoming unintentionally disengaged. Here, the lower edge (lower end) of the engaging protruding portion 15*c* is included in the "lower edge 15*g* of the elastic portion 15". In other words, the lower edge (lower end) of the engaging protruding portion 15*c* hits the upper surface 12*f* of the lower body 12*e*, thereby limiting the inclination of the section in which the engaging protruding portion 15*c* is formed.

A protruding portion extending in another direction may be formed on either the upper surface 12*f* of the lower body 12*e* or the elastic portion 15. In one example of the first housing 11, as shown in FIG. 2, protruding portions 12*m*, 12*n* extending upwards towards the lower edge 15*g* of the elastic portion 15 are formed on the upper surface 12*f* of the lower body 12*e*. In the section in which the protruding portions 12*m*, 12*n* are formed, the distance between the upper surface 12*f* of the lower body 12*e* and the lower edge 15*g* of the elastic portion 15 is small (see width W3 of the gap in FIG. 3A). As a result, the section in which the engaging protruding portion 15*c* is formed, as shown in FIG. 6B, is more reliably prevented from becoming inclined to the rear. The protruding portions 12*m*, 12*n* may be formed on the lower edge 15*g* of the elastic portion 15, or may be formed on both the lower edge 15*g* of the elastic portion 15 and the upper surface 12*f* of the lower body 12*e*. In the explanation here, the lower edge (lower end) of the protruding engaging portion 15*c* is included on the "lower edge 15*g* of the elastic portion 15". Therefore, a protruding portion may be formed on the lower edge (lower end) of the engaging protruding portion 15*c*.

As shown in FIG. 6A, in one example of the first housing 11, a slight gap is provided between the protruding portions 12*m*, 12*n* and the lower edge 15*g* of the elastic portion 15. However, a gap does not have to be provided. In other words, the protruding portion preventing inclination of the section in which the engaging protruding portion 15*c* is formed (protruding portion 12*m* in the present explanation) may come into contact with the member on the opposite side (the lower edge 15*g* of the elastic portion 15 in the present explanation).

As shown in FIG. 3A, when the first housing 11 is viewed from the front, the protruding portion 12*m* is positioned below the engaging protruding portion 15*c*. As described above, in one example of the first housing 11, a plurality of engaging protruding portions 15*c* are formed in the elastic portion 15 (more specifically, two engaging protruding portions). In one example of ft the protruding portion 12*m*, as shown in FIG. 3A, the width in the transverse direction corresponds to the engaging protruding portion 15*c*. The width of the protruding portion 12*m* may be larger than the engaging protruding portion 15*c* or smaller than the engaging protruding portion 15*c*.

As shown in FIG. 3A, in one example of the first housing 11, the protruding portion 12*n* positioned between the two protruding portions 15*c* when viewed from the front of the first housing 11 is formed in the upper surface 12*f* of the lower body 12*e*. This protruding portion 12*n* more effectively prevents inclination of the section including the engaging protruding portion 15*c* from becoming inclined to the rear as indicated in FIGS. 6A and 6B. The protruding portion 12*n* does not have to be formed. Alternatively, protruding portion 12*n* may be formed and protruding portion 12*m* not formed.

As shown in FIG. 2, the elastic portion 15 may have a section 15*h* at the end of the lower edge 15*g* which is connected to the upper surface 12*f* of the lower body 12*e* (the section 15*h* is referred to as the connecting portion below). By adjusting the width of the connecting portion 15*h* (W1 in FIG. 3A), the elasticity of the elastic portion 15 can be controlled and inclination of the section in which the engaging protruding portion 15*c* is formed can be suppressed. As described above, in one example of a first housing 11, the lower end 15*e* of the fixed portion 15*a* of the first housing 11 is also connected to the upper surface 12*f* of the lower body 12*e* (see FIG. 2).

Figure 4:
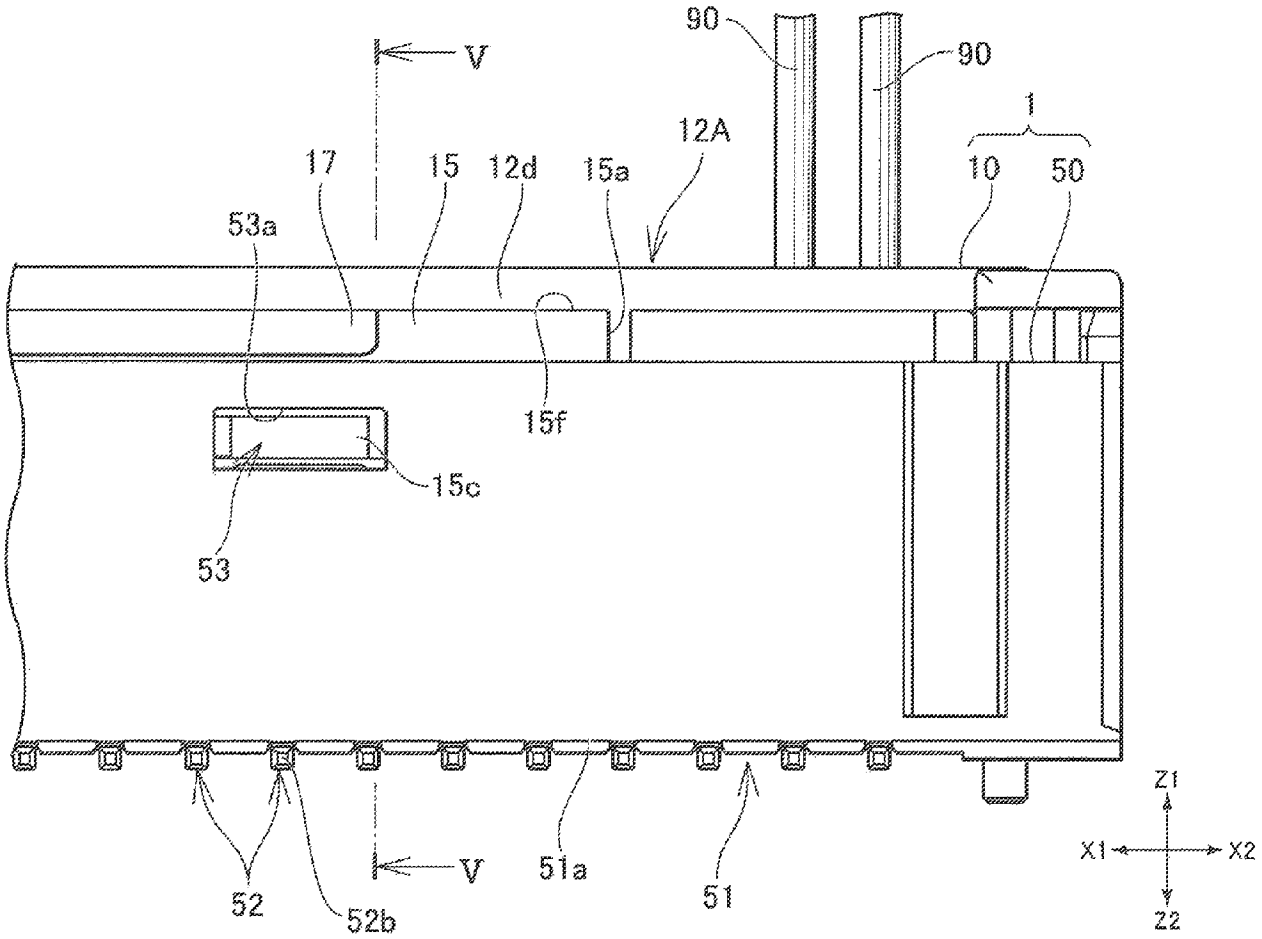
FIG. 4 is a front view of the connector assembly.

As shown in FIG. 1, the elastic portion 15 has an operating portion 17 protruding forward. The operation portion 17 is positioned above and away from the engaging protruding portion 15*c*. The operating portion 17 has a protruding width that is larger than the engaging protruding portion 15*c* and is positioned above the upper edge of the second housing 51 when the first housing 11 and the second housing 51 are coupled (see FIG. 4). When the operator pushes the operating portion 17 to bend the elastic portion 15, the engaging protruding portion 15*c* and the engaging hole 53 are disengaged. In one example, the upper edge of the operating portion 17 is positioned at the same height as the upper edge 15*f* of the elastic portion 15. The position of the operating portion 17 may be lower than the upper edge 15*f* of the elastic portion 15.

When viewed from the front of the first housing 11, the operating portion 17 is preferably above the engaging protruding portion 15*c*. In this way, the engaging protruding portion 15*c* and the engaging hole 53 are easily disengaged when the operating portion 17 is pushed.

The elastic portion 15 has a plurality of engaging protruding portions 15*c* positioned apart from each other in the transverse direction as mentioned above. The length of the operating portion 17 in the transverse direction preferably corresponds to the overall width of the plurality of engaging protruding portions 15*c*. Here, the overall width of the plurality of engaging protruding portions 15*c* is the distance from the right end of the engaging protruding portion 15*c* positioned farthest to the right to the left end of the engaging protruding portion 15*c* positioned farthest to the left. In the example shown in FIG. 3A, the width of the operating portion 17 corresponds to the overall width W2 of the two engaging protruding portions 15*c*. In this way, the engaging protruding portion 15*c* and the engaging hole 53 are easily disengaged when the operating portion 17 is pushed.

As explained above, in the connector assembly 1, the engaging protruding portion 15*c* of the first housing 11 is positioned between the upper edge 15*f* and the lower edge 15*g* of the elastic portion 15. In this way, the engaging protruding portion 15*c* is not displaced very much even when the elastic portion 15 is subjected to external force and becomes inclined. This can keep the engaging protruding portion 15*c* and the engaging hole 53 from becoming unintentionally disengaged.

Also, the first housing 11 has a section positioned below the lower edge 15*g* of the elastic portion 15 but facing the lower edge 15*g* of the elastic portion 15 in the vertical direction. In one example of the terminal holding member 12A, as shown in FIG. 2, the section facing the lower edge 15*g* of the elastic portion 15 includes the upper surface 12*f* of the lower body 12*e*. This can keep the section in which the engaging protruding portion 15*c* is formed from becoming inclined in the rearward direction as shown in FIG. 6B.

The present disclosure is not limited to the embodiments explained above. Many other variations are possible. For example, an engaging hole can be formed in the elastic portion 15, and a protruding engaging portion for insertion into the engaging hole in the elastic portion 15 can be formed in the second housing 1. Also, engaging protruding portions that can engage each other can be formed on both the elastic portion 15 and the second housing 51.

The invention claimed is:

1. A connector assembly the connector assembly comprising:

a first connector having a first housing for holding first terminals; and a second connector having a second housing for holding second terminals, wherein the second housing is configured to be coupled with the first housing in a first direction, the second housing having a second engaging portion, the first housing having two fixed portions positioned apart from one another in a second direction orthogonal to the first direction, the first housing having an elastic portion passing between the two fixed portions and bending in a third direction orthogonal to both the first direction and the second direction, the elastic portion having a first engaging portion formed thereon, the first engaging portion able to be hooked on the second engaging portion, the elastic portion having a first edge and a second edge positioned on opposite sides in the first direction, and the first engaging portion being positioned between the first edge and the second edge, wherein the first engaging portion is formed in the elastic portion closer to the first edge than to the second edge in the first direction, and the first housing has a section positioned in the first direction relative to the first edge and facing the first edge in the first direction, and wherein the first edge of the elastic portion hits the section of the first housing facing the first edge before the first engaging portion and the second engaging portion disengage when the first engaging portion formed in the elastic portion is inclined due to force in the separating direction for the first housing and the second housing while the first engaging portion and the second engaging portion are engaged.

2. The connector assembly according to claim 1, wherein either the section of the first housing facing the first edge or the first edge of the elastic portion has a protruding portion protruding towards the other one.

3. The connector assembly according to claim 2, wherein the protruding portion is positioned in the first direction relative to the first engaging portion when the first housing is viewed in the third direction.

4. The connector assembly according to claim 1, wherein a position of the first engaging portion in the first direction is between a position of a first end portion and a position of a second end portion of the fixed portion in the first direction.

5. The connector assembly according to claim 1, wherein the elastic portion has at least two first engaging portions positioned apart from one another in the second direction.

6. The connector assembly according to claim 1, the section of the first is formed along the first edge, and an end portion of the first edge is connected to the section formed along the first edge.

* * * * *